US006418194B1

(12) United States Patent
McPherson et al.

(10) Patent No.: US 6,418,194 B1
(45) Date of Patent: Jul. 9, 2002

(54) HIGH SPEED X-RAY BEAM CHOPPER

(75) Inventors: Armon McPherson, Oswego; Dennis M. Mills, Naperville, both of IL (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/537,992

(22) Filed: Mar. 29, 2000

(51) Int. Cl.[7] ..... G21K 5/10
(52) U.S. Cl. ..... 378/160; 378/145
(58) Field of Search ..... 378/86, 89, 145, 378/146, 147, 160, 16

(56) References Cited

U.S. PATENT DOCUMENTS 5,224,136 A * 6/1993 Toth et al. ..... 378/4

OTHER PUBLICATIONS

Christensen's Physics of Diagnostic Radiology, Curry, Dowdey, Murray, 4th ed., 1990, pp. 70–86 and 93–98.*

Armon McPherson et al. "A New High–Speed Beam Chopper for Time–Resolved X–ray Studies" *J. Synchtron Rad.* (2000) 7, 1–4.

* cited by examiner

*Primary Examiner*—David P. Porta
*Assistant Examiner*—Therese Barber
(74) *Attorney, Agent, or Firm*—Bradley W. Smith; Mark P. Dvorscak; Virginia B. Caress

(57) ABSTRACT

A fast, economical, and compact x-ray beam chopper with a small mass and a small moment of inertia whose rotation can be synchronized and phase locked to an electronic signal from an x-ray source and be monitored by a light beam is disclosed. X-ray bursts shorter than 2.5 microseconds have been produced with a jitter time of less than 3 ns.

17 Claims, 5 Drawing Sheets

HIGH SPEED X-RAY BEAM CHOPPER

CONTRACTUAL ORIGIN OF THE INVENTION

The United States Government has rights in this invention pursuant to Contract No. W-31-109-ENG-38 between the U.S. Department of Energy and the University of Chicago, representing Argonne National Laboratory.

FIELD OF THE INVENTION

The present invention relates to the field of particle and radiation beam choppers and more specifically, the present invention relates to the field of choppers for x-ray beams.

BACKGROUND OF THE INVENTION

Many experiments in physics, chemistry, biology, materials science, and other disciplines require irradiation of a sample by a short burst of x-ray radiation after which the response of the sample is studied in detail. X-ray irradiation is an important area of study for it allows for the investigation of high energy bonding within the material. A typical experiment may consist of excitation of a system by an x-ray pulse and then measuring the fluorescence emitted during the system's de-excitation phase. In a pump-probe experiment, a system may be prepared by laser excitation and then have a pulsed x-ray beam used to monitor the time evolution of the system. A typical energy for the x-ray radiation is of the order of a few keV. Inasmuch as the time evolution of the phenomena under study may be as short as several microseconds, x-ray pulses on the order of microseconds or less are required.

The primary source of high flux x-ray pulses is a synchrotron storage ring, although use of laser-produced plasma is becoming more frequent. The salient features of synchrotron storage rings are the high flux per unit solid angle, the beam collimation and the x-ray energy tunability. With the advent of third generation storage rings, the temporal structure of the stored charge has been exploited for time resolved studies.

Short duration x-ray bursts typically are produced when a continuous x-ray beam passes through a mechanical shutter that is open for a very short time. One x-ray chopper is disclosed in A. D. LeGrand, et al. *Nuclear Instruments and Methods in Physics Research* A275 pp 442–446 (1989), so designated as prior art in FIG. 1. Briefly, an x-ray beam 2 is incident perpendicular to a rotating wheel 3. On the outer periphery of the wheel is a slot 4 having width d. The x-ray beam is transmitted beyond the plane of the wheel only when aligned with the slot 4. This system delivers an x-ray burst whose duration is given by $$t=d/fC \qquad \text{Equation 1}$$

where f designates the rotation frequency of the wheel, d designates the width of the slot and C designates the wheel circumference. The above expression underscores the necessity of having a large wheel circumference C at the same time as a-very high rate of rotation.

The centrifugal force acting on the wheel varies as $f^2C$. Thus, strong mechanical stresses are encountered as one increases either the wheel circumference or the rotation frequency. To date, rotation periods less than 1 millisecond are rarely achieved. The typical wheel circumference is less than 0.5 meters.

Another chopper arrangement, depicted in FIG. 2, also as prior art, utilizes a cylinder of length L rotating around an axis defined by a shaft 15. An x-ray beam 20 is incident in a direction parallel to the axis. The cylinder is rotated by a motor 25. At a specified radius of the cylinder a rectilinear channel 35 has been cut parallel to the shaft. The cylinder rotates about its axis as shown, and clockwise as seen looking down the beam direction. Points A and B indicate the boundaries of the channel where the beam enters. Likewise, points C and D define the boundaries of the channel where the beam exits.

The duration of the transmitted x-ray beam is determined as follows. Consider a point E fixed in space at a radius r and intermediate between A and B and a corresponding point F fixed in space and intermediate between C and D. Points E and F define a line parallel to line AC. A photon entering at E will be transmitted through the beam chopper only if it reaches F before the cylinder's rotation has brought C to the point F. If s is the distance CF, then C reaches F in a time s/fW, where f is the rotation frequency of the cylinder and W is the circumference of the cylinder at the radius r. The photon's travel time is L/c where c is the speed of light. Thus a photon entering at E will exit at F if $s \geqq LfW/c$. Only the photons entering the channel between E and B will be able to pass through the rotating cylinder. The distance EB is in effect the effective width $d_{eff}$ of the channel, with $$d_{eff}=d-s=d-LfW/c. \qquad \text{Equation 2}$$

The length of the burst in this case is $$t_{eff}=d_{eff}/fW \qquad \text{Equation 3}$$

The above instrument for producing a short radiation burst requires a long cylinder, a fast rotation rate and a large cylinder diameter. (In any event, L must be large enough to ensure absorption in the cylinder when the x-ray beam is not being transmitted through the channel and the circumference must be large enough to allow the transmitted x-ray beam to clear the motor 25.) Such a long cylinder with a large diameter entails a large mass and a large moment of inertia. This entails a large stress on the bearings of the motor. This is especially relevant when dealing with a horizontal beam and consequently a cylinder rotating in the horizontal plane, inasmuch as considerable torque is placed on the motor bearings.

Another disadvantage of the rotating cylinder configuration is that unless the walls of the channel are oriented in the radial direction, as illustrated in FIG. 2, rather than parallel, the effective width of the channel increases the deeper the x-ray beam traverses the channel.

In addition to the mechanical problems with current beam choppers described above, there is the stability of the rotation speed of the wheel or cylinder to be considered. Synchrotrons provide bursts or packets of radiation at specific intervals. However, typical choppers often lack the motor speed control necessary to synchronize with the temporal structure of the storage ring so as to take advantage of the full time structure of the storage ring without resorting to expensive electronics.

Thus there is a need in the scientific community for a fast x-ray beam chopper that overcomes the large size of the above designs, is economical to operate, and that can utilize the natural time structure of synchrotron storage rings for time resolved measurements.

SUMMARY OF THE INVENTION

An object of the present invention is to provide a fast x-ray-chopping device that overcomes the disadvantages in the prior art.

Another object of the present invention is to provide a fast x-ray-chopping device that can be synchronized with the temporal structure of a storage ring. A feature of the present invention is that the rotation of the beam chopper can be phased-locked to the synchrotron storage ring orbital frequency. An advantage of the present invention is that the chopper can take advantage of the variable loading pattern of the storage ring (e.g., by admitting only a predetermined packet of energy) to take full advantage of a single x-ray pulse or a pulse train therefrom.

Yet another object of the present invention is to provide a compact fast x-ray-chopping device. A feature of the present invention is that the moving item that chops the beam is a thin rotating disk. An advantage of the present invention is that the rotating assembly has a low mass and a low moment of inertia, thereby allowing for rapid fine-tuning of the rotational speed of the disk. A further advantage of the present invention is that the rotating assembly is integrally molded to the motor rotor and hence coupling to a motor is not necessary.

Yet another object of the present invention is to provide a fast x-ray-chopping device, the performance of which can be monitored accurately. A feature of the invention is that the chopper can be made to also admit and transmit an optical beam in addition to the x-ray beam. An advantage of the present invention is that the performance of the chopper can be ascertained by studying the transmitted optical beam.

A further object of the present invention is to provide an economical fast x-ray-chopping device. A feature of the present invention is that it comprises a commercially available motor capable of a high rate of rotation and a high degree of speed regulation. An advantage of the invention is that the use of standard motor units minimizes repair and upkeep costs.

In brief, the present invention provides a fast, economical, and compact x-ray chopper with a small mass and a small moment of inertia whose performance allows synchronization to the temporal structure of a synchrotron storage ring. Specifically, the invention is a device for chopping x-ray beams emanating from a source, the device comprising a rotating disk, whereby the disk defines a channel extending along a diameter of the disk.

Also provided is a device for chopping x-ray beams comprising a rotating disk having a first side and a second side, said disk defining a passage extending along the entire diameter of the disk.

Also provided is a device for chopping x-ray beams comprising a rotating disk having a first side and a second side, said disk defining a passage extending along the entire diameter of the disk.

BRIEF DESCRIPTION OF THE DRAWING

The invention together with the above and other objects and advantages will best be understood from the following detailed description of the preferred embodiment of the invention shown in the accompanying drawing, wherein.

DETAILED DESCRIPTION OF THE INVENTION

A high-speed x-ray beam chopper, that can be phase-locked to the temporal structure of a synchrotron storage ring, has been invented. This chopper can be used in time resolved measurements of various phenomena. Detail of one embodiment of the invented chopper is found in McPherson, et al. "A New High-Speed Beam Chopper for Time-Resolved X-Ray Studies" *J. Synchrotron Rad* (2000) 7, pp1–4, and incorporated herein by reference.

The device embodies a motor controller that accepts the rf frequency of a synchrotron storage ring as the master clock of the device. This allows the beam chopper rotation speed to be synchronized to the orbital frequency of the storage ring. By this synchronization, any portion of the storage ring fill pattern can be positioned within the beam chopper transmission-time window. As such, storage rings comprising either symmetrical or asymmetrical loading patterns can be utilized.

A salient feature of the invented beam chopper is the high level of rotor speed regulation. The rotor disk has a plurality of polished facets equally spaced around its circumference. An optical encoder reflects an optical beam from these facets and feeds the frequency to a speed control circuit in electrical communication with the motor controller board. Feedback to the driver circuit regulates the rotor speed.

With appropriate modification or specification of the chopper motor rpm speed, the invented chopper design is adaptable to different synchrotrons. Generally, to facilitate phase locking of the rotation frequency of the chopper to the storage ring's revolution frequency, and also to have the maximum duty cycle, the ratio of the storage ring revolution frequency to the beam chopper rotation frequency should be the smallest possible integer consistent with the maximum beam chopper speed available.

An exemplary chopper has been produced for use at the Argonne National Laboratory Advanced Photon Source (APS). As such, the chopper is designed to operate with an open time window of 2400 ns, equal to approximately 64 percent of the revolution time of the APS storage ring. When the storage ring operates at its maximum fill current, maximum photon flux from the storage ring can be delivered to a target within the specified beam chopper time window when the storage ring fill pattern covers only 64 percent of the ring's fill space. A salient feature of the invented chopper design is that this time window also allows the chopper to capture the photon flux contained in a single bucket in the ring, as long as this bucket dwells in the 64 percent storage space region of the ring and the remaining charge is contained in the other 36 percent of the ring space. The above two "harvesting" scenarios are facilitated by the chopper's ability to phase lock its open time window to the revolution frequency of the storage ring. Essentially, the chopper operates at a rotational frequency that is a harmonic of the storage ring rotation frequency.

Figure 1:
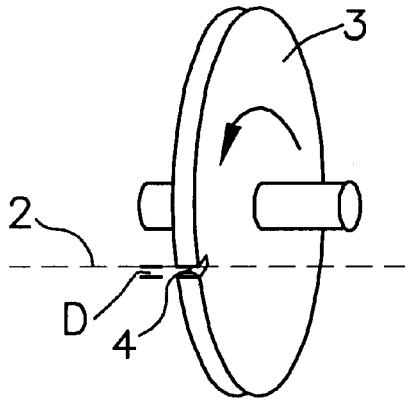
FIG. 1 PRIOR ART
FIG. 1 is a schematic view of a prior art, fast x-ray-chopping device.
Figure 2:
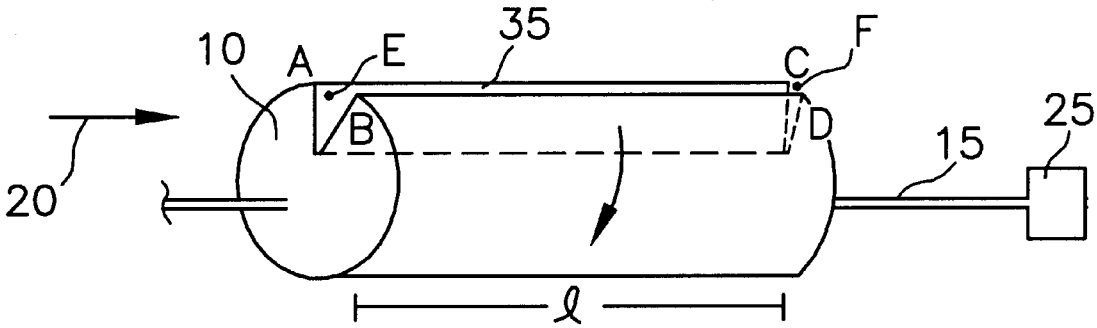
FIG. 2 is a schematic view of another prior art x-ray chopping device.
Figure 3:
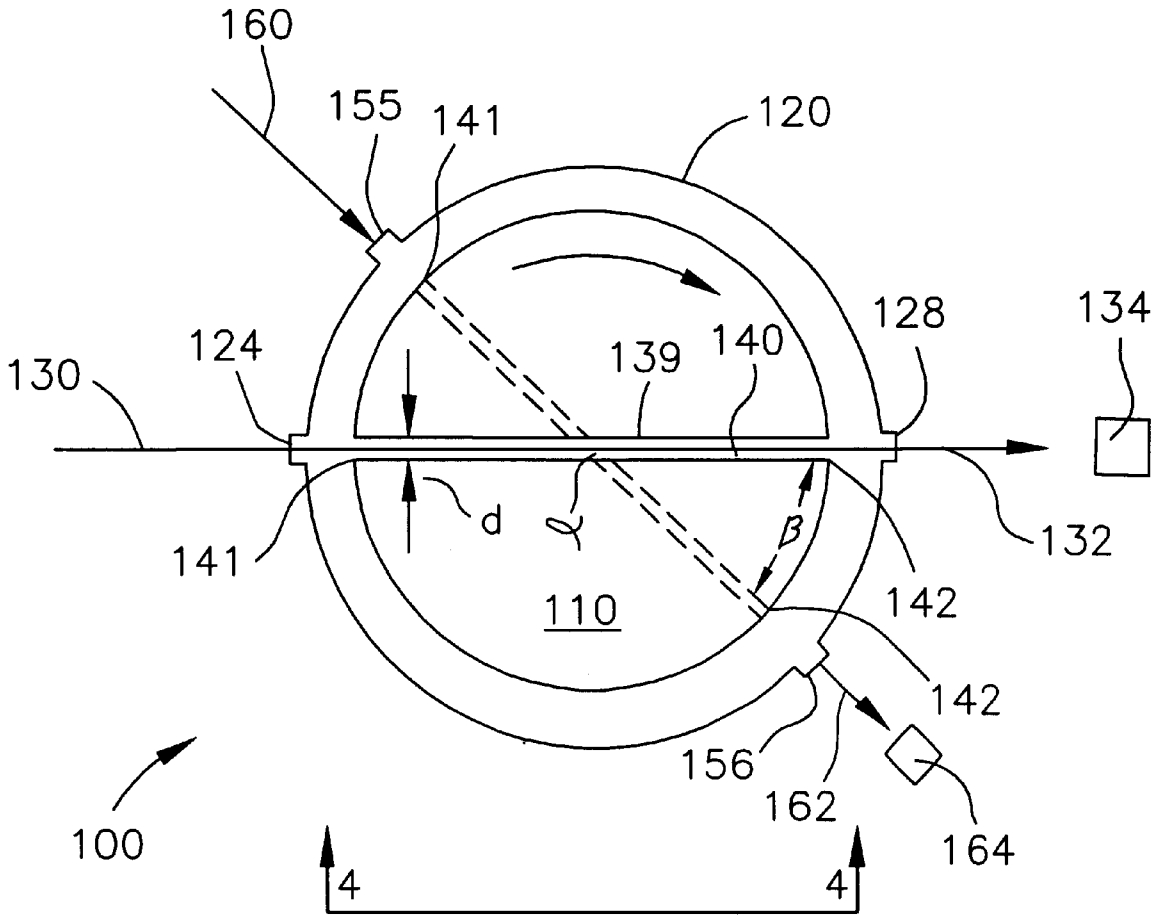
FIG. 3 is a cut-away, schematic plan view of a fast x-ray-chopping device, in accordance with features of the present invention.

Referring to FIG. 3, a cut-away schematic diagram of the invented chopper is illustrated. The disk is shown with its top half removed to fully show a channel 140 through which x-rays traverse. A salient feature of the invention is a disk 110 rotating at a high rotational frequency and adapted to permit traversal of radiation only through specific regions of the disk. Specifically, the channel 140 spans the diameter of the disk, and is adapted to receive and transport radiation along its length. The channel has a first end 141, a second end 142, and a width d. The disk rotational speed is determinant upon a motor 175 (see FIG. 4) utilized to actuate the chopper.

The disk is inside an enclosure (i.e. housing) 120. The housing will contain regions defining two pairs of windows, positioned in relation to each other at a specified angular separation β. The windows of each pair align with the channel 140 to form two separate beam-ways. One set of windows 124, 128 accommodates chopper alignment with an x-ray beam. Another set of windows 155, 156 accommodates chopper alignment with a beam of visible light.

Specifically, regions of the housing 120 define opposing apertures or ports 124 and 128 through which an x-ray beam 130 may enter and exit respectively. Generally, the ports 124, 128 represent points defining a line extending along the diameter of the disk 110, and as such, are situated coplanar to the disk. For every complete revolution of the disk, this channel 140 is twice coaxial to this line. As noted supra, the channel extends through the center of the disk and perpendicular to the rotation axis α of the disk.

An x-ray beam 130 enters the channel 140 when the first end 141 of the channel 140 opposes (i.e., is aligned with) port 124 (at which time the second end 142 opposes port 128) and also, half a revolution later, when the second end 142 faces port 124. In both of these situations an x-ray burst 132 emerges out of the housing 120 and can be used in an experiment 134.

The chopper initially is fabricated to provide a specific x-ray pulse duration. The duration of the x-ray pulses can be varied by changing any of the rotation rate f, the channel width d, and/or the wheel diameter, D. For example, the faster the rotation rate f (in Hz) and/or the narrower the channel width d, and/or the longer the diameter of the wheel D the shorter the burst of x-rays, 132. As such the duration of the transmitted x-ray pulses is given by $$t=[\arctan (d/D)]/180f \qquad \text{Equation 4}$$

where d is the channel width, D is the disk diameter, and f is the rotation frequency.

FIG. 3 also shows an optical beam 160 entering the housing 120 through a port 155. A port 156 is provided through which the optical beam may exit. When the channel 140 is co-linear with a line defined by ports 155 and 156, the optical beam 160 entering the housing 120 is transmitted when the first end faces port 155 (at which time second end faces port 156) and also, half a revolution later, when the second end faces port 156. In both of these situations an optical burst of light 162 emerges out of the housing 120, after traversal along the channel and can be monitored with an apparatus 164.

Figure 4:
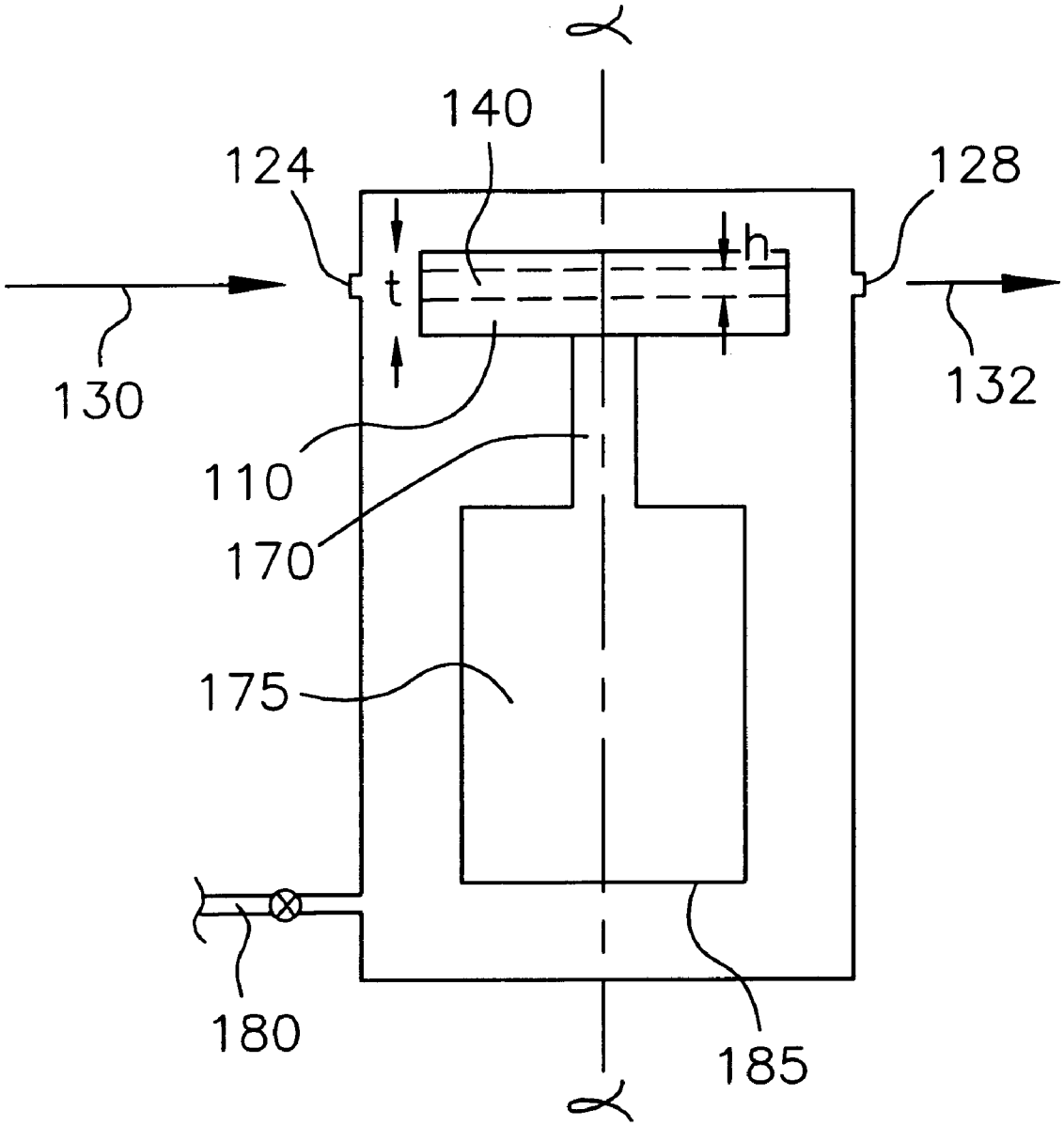
FIG. 4 is a schematic cross sectional view of a fast x-ray-chopping device, in accordance with features of the present invention.

FIG. 4 shows a schematic view of the invented x-ray beam chopper taken along line 4—4 of FIG. 3. However, FIG. 4 depicts the fully intact disk, i.e., without its top half removed. The disk 110 has a thickness t, is affixed to, and rotates around a shaft 170 that is acted upon by a motor 175. Alternatively, the shaft of the air bearing is a cylindrical rotor that flares into a disk configuration. In this alternative instance, the disk is integrally molded to the shaft.

The channel 140 cut through the disk 110 has a depth h. In a preferred embodiment, the channel is defined by an aperture which spans the diameter of the disk and takes the form of a tunnel through the disk. As such, the channel extends along the diameter of the disk so as to be interior to the thickness of the disk. The ends of the channel form apertures to the outside of the disk so as to allow a means of ingress and egress of x-ray beams traversing the channel. Generally, these apertures breach the circumferencial periphery of the disk.

An upwardly facing, external surface of the disk also can define a channel way. In this second instance, the channel takes the form of a trough. Similar to the internal tunnel described above, the ends of the trough breach the circumference of the disk so as to provide a means of ingress and egress for x-rays traversing the longitudinal axis of the trough.

When the first end 141 and second end 142 of the channel 140 oppose the entrance and exit ports 124 and 128, respectively, the incoming beam 130 traverses the channel, thereby producing an x-ray burst 132. The depth of the channel h does not affect the duration of the x-ray burst 132.

The x-ray beam emanating from the channel is detected as a "burst" by a detector 134, which also could represent a time-resolved experiment.

Optionally, the housing is provided with means 180 through which the housing may be evacuated and then filled with a specified fluid and at a specified pressure. For example, in the instant embodiment, a noble fluid such as helium is utilized to confer a low friction atmosphere for operation of the air bearing of the motor. As such the beam-way housing apertures 124, 128 and 151, 152 are adapted to receive windows 124, 128, 155, 156 which are transparent to the radiation directed at them. The housing 120 provides windows that are hermetically sealed to maintain one (1) atmosphere of helium. Also shown are electrical means 185 through which the motor 175 is powered and controlled.

Also, FIGS. 3 and 4 distinctively illustrate the advantages of the proposed invention. First, the disk 110 need not be of considerable thickness, thus reducing the moment of inertia. The thickness k need only be sufficient to accommodate the depth h of the channel and to withstand the centrifugal forces on the disk as it is rotated around the shaft 170. Thus the disk 110 may be light weight without increasing the time duration of the x-ray burst 132. The motor 175 is not positioned along the path of the x-ray beam 130 and this allows greater flexibility in the choice of the motor's dimensions and other characteristics.

Performance Testing of the Beam Chopper

The inventors designed and operated an x-ray chopper in conjunction with the Advanced Photon Source (APS) at Argonne National Laboratory, Argonne, Ill. As such, the specific chopper designed to work with the APS operates at a rotational frequency that is a harmonic of the APS orbital frequency.

The APS Storage Ring is designed to operate with 1296 stable orbital positions, referred to herein as "buckets". Charged particles (e.g. electrons or positrons) are stored within these buckets. The width of a bucket is 2.841 ns, but the charge is stored in the smallest possible region, presently within the center 50 to 100 ps.

A typical loading pattern for the storage ring is a sextet, wherein the charge is stored in six adjacent buckets, followed by a series of triplets (i.e., charge stored in three adjacent buckets) or singlets spaced about every 120 ns. During the test described herein, the storage ring was filled with a sextet followed by a triplet's sequence of 25 groups of three consecutively filled buckets repeating every 36 buckets. The gap between the sextet and the first triplet consists of 66 empty buckets, and the gap between triplets consists of 33 empty buckets. Since this fill pattern does not cover the entire ring space, there is a gap of 357 empty buckets between the last triplet and the initial sextet.

The beam chopper is mounted onto a rotational stage to align the ports 124, 128 with the x-ray beam. The chopper's rotating axis may be in either the horizontal plane or perpendicular with respect to the x-ray beam. A myriad of commercially-available rotational stages are suitable. The inventors utilized a Series 400 stage manufactured by and obtainable through Blake Industries, Ind., Scotch Plains, N.Y.

Any x-ray beam can be chopped with the invented device. Optionally, an x-ray beam can be modified prior to reaching the chopper. For example, and depending on the source of x-rays and other characteristics of the beam, the x-ray is first reflected off of a collimating mirror to reduce its high energy content and improve collimation. A means for monochromatizing the beam to a suitable energy is then utilized. In the example, a pair of Si crystals were used. The second crystal was slightly bent to sagitally focus the x-ray beam to about 1 mm horizontally. Notwithstanding the foregoing, the invented chopper is fully operational without collimating in-coming x-ray beams.

The 0.5 mm width of the channel 140 of the disk 110 produced an x-ray burst lasting 2.45+/−0.05 microseconds, corresponding to two thirds of the APS storage ring orbital period. Inasmuch as the charge in the storage ring is stored in "buckets" rather than in a continuous fashion, it is imperative that the phase of the motor, which in turn determines when the channel 140 is aligned with the entrance port 124, be locked to the phase of the temporal structure of the fill pattern of the buckets.

Control of the phase difference between the APS beam and the motor rotor was achieved by means of a commercial delay generator (Stanford model 535). Delay steps of 100 ns could be used without loss of phase locking to the temporal structure of the APS beam.

An avalanche photo diode detector (APD) with a temporal resolution of 5 ns was used to observe the temporal structure of the 8 keV x-rays transmitted through the beam chopper's transmission time window. The signal was recorded on a digital oscilloscope in a time-averaged mode of 100 trigger events. Inasmuch as the spacing between buckets within a sextet or triplet is 2.5 ns, the 5 ns resolution of the APD prevented the internal structure of the sextet and the triplet from being resolved.

In an exemplary embodiment of the invented device, the open window time of the chopper was 2.45 microseconds. Phase locking circuitry within the motor controller allowed the rotor speed to be controlled better than 5 ppm at a rotational speed of approximately 80,000 rpm. This resulted in a jitter (i.e. variation in the time required for a revolution) of only 3 nanoseconds in the open window time.

The present device achieves a high level of rotor speed regulation via optical feedback. Specifically, the rotor disk 120 has four polished facets equally spaced along the circumference, which reflect an internal incident optical beam. The frequency at which the incident beam is reflected is fed to a speed control circuit for the motor where it is compared to the master clock frequency driving the motor.

Chopper-APS Synchronization Detail

Two operational tests, discussed below, were performed to demonstrate the performance of the beam chopper at the APS. The first test demonstrated that the rotational motion of the beam chopper rotor could be phase-locked to the orbital frequency of the APS storage ring. For the second test, a laser pulse was synchronized to specified parts of the temporal structure of the x-rays transmitted through the beam chopper.

$P_0$ Synchronization

The APS Storage Ring radio frequency, $f_{rf}$, serves as the master clock. It is supplied as ($f_{rf}$÷1296) from the accelerator control room. This master clock frequency is sent to a frequency divider that divides it by 51 to produce a frequency of 5324.48 Hz (the precision is determined by the rf frequency from the accelerator control system). This resulting frequency is used as both the driving frequency for the beam chopper motor controller and the reference frequency for speed regulation. The rotor's rotational frequency of 1331.12 Hz is thus phase locked to the APS storage ring orbital frequency.

After motor turn-on, the rotor reaches its maximum speed, corresponding to a rotational frequency of about 1331.12 Hz, in approximately 15–20 seconds. With a 0.5 mm-wide slot, a 2450 ns open window time exists, corresponding to approximately 67 percent of the APS storage ring revolution time. As noted supra, inasmuch as the channel is cut through the diameter of the rotor disk, there are two transmission time windows per revolution. The dead time between transmission time windows is approximately 373 microseconds ($\mu$s).

As noted supra, the chopper speed is determinant upon the motor 175 utilized. In this example, a high speed air bearing configuration available from Speedring System, Inc., of Rochester Hills, Mich. was utilized.

Inasmuch as the motor 175 has a 5 ppm speed regulation, the precision of the beam chopper motor frequency is approximately 79867.18±0.4 RPM.

Laser Synchronization

The timing capability of the chopper is also demonstrated by synchronization of a laser pulse to the x-ray beam transmitted through the beam chopper. By varying the delay between the arrival of the x-ray and laser pulses onto a detector or target, the exact time delay so obtained allows sensitive laser/x-ray interaction experiments.

For this test, a light pulse from an Nd:Yag laser (Model #GCR-170 available through Spectra-Physics, located in Mountain View, Calif.) firing at approximately 10 Hz, is detected by a photo diode and used to trigger an oscilloscope. The oscilloscope utilized by the inventors was a Tektronix Model 754A, of Tektronix, Wilsonville, Oreg.

A variable output frequency divider, running off the APS control room master clock, is used to supply the drive frequency for the beam chopper motor controller and to trigger firing of the laser. Since the ratio of the beam chopper drive frequency and the laser trigger frequency is an integer, phase locking was immediate.

A digital delay generator was used to shift the phase between the beam chopper rotor rotation and the storage ring orbital frequency. Another delay generator is used to shift the trigger of the laser pulse to any part of the transmitted x-ray beam.

Figure 6:
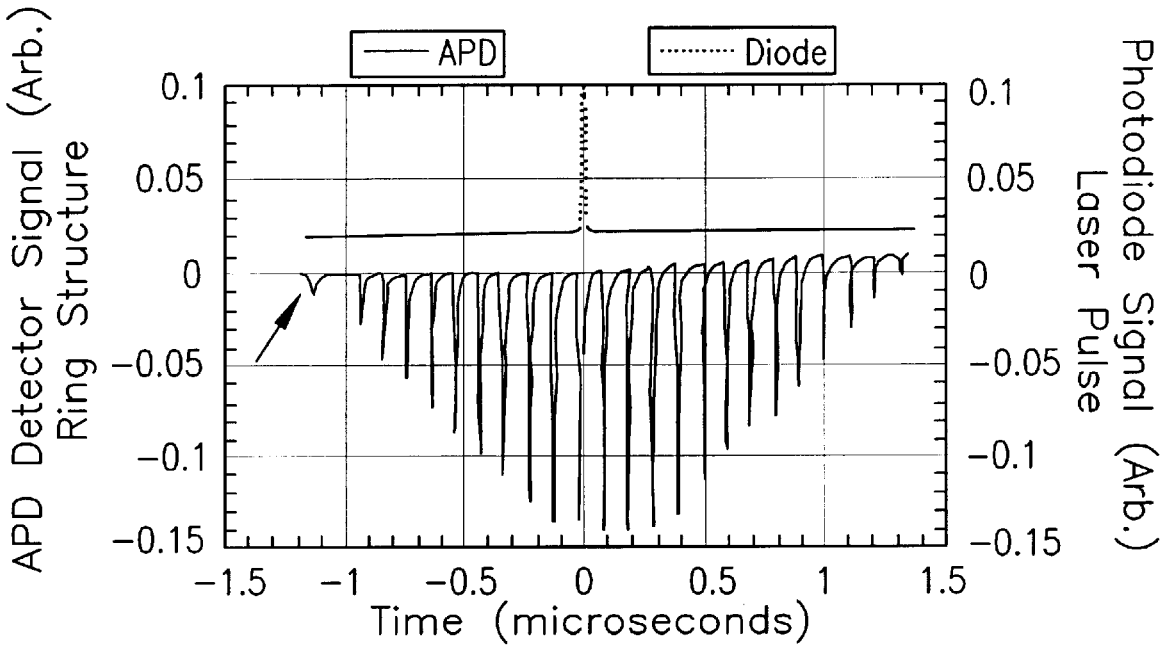
FIG. 6 is an oscilloscope pattern of the phase locked chopper and the synchronization of a laser pulse, in accordance with features of the present invention.

The results of both the $P_0$ phase lock test and the laser synchronization test are depicted in FIG. 6. As depicted by the arrow thereon, the transmission window of the beam chopper is positioned such that the sextet is just visible. With 23 triplets observed, the transmission window open time is estimated to be 2450±50 ns. The integrated area under each peak represents the number of photons recorded for the sextet and each observed triplet. Since the x-ray beam is larger than the width of the beam chopper slit, the profile of the transmitted ring structure (i.e., the transmission function) is triangular.

The laser signal, positioned after the 10 triplet, was used as the scope trigger.

Figure 7:
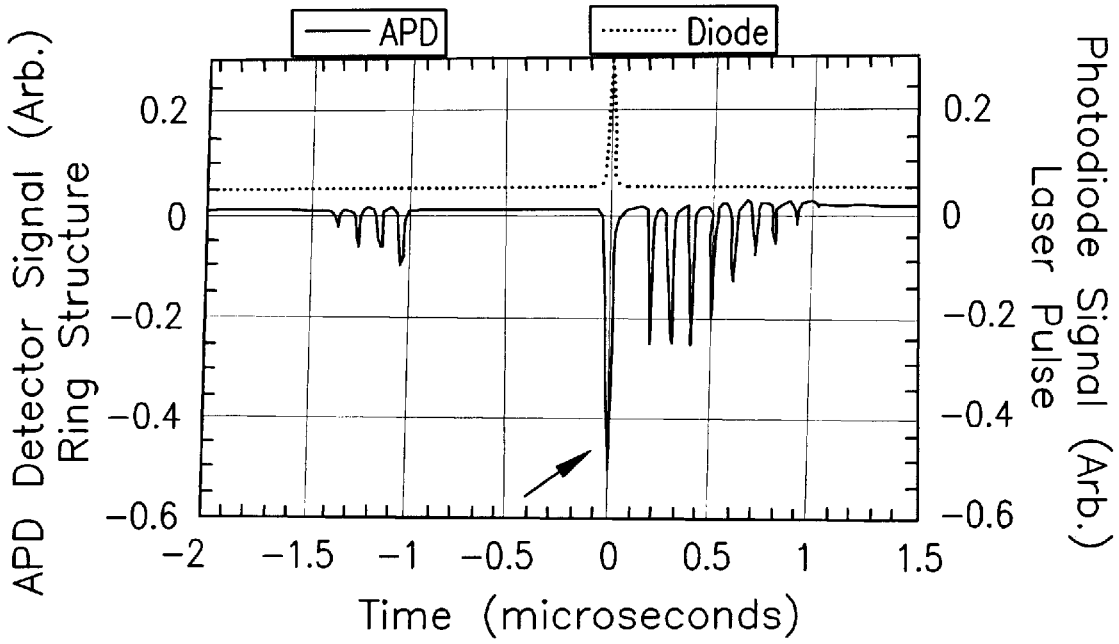
FIG. 7 is an oscilloscope pattern of another portion of the storage x-ray ring transmitted through the chopper and concomitant laser synchronization, in accordance with features of the present invention.

By delaying the drive frequency to the beam chopper motor controller, any part of the storage ring fill pattern can be sent through the beam chopper transmission window. Adjusting the delay to the laser trigger then allows synchronization of the laser pulse to a different section of the x-ray structure, as illustrated in FIG. 7. The laser pulse is synchronized to the sextet, indicated by the arrow.

In summary, the inventors found that the transmission time window of the invented chopper can be positioned on any portion of the APS storage ring time structure. Also, with proper controlled delay, a laser pulse can be made to arrive onto a target material at any specified time (within the operational jitter of the components) before or after an x-ray pulse from the storage ring.

Figure 5:
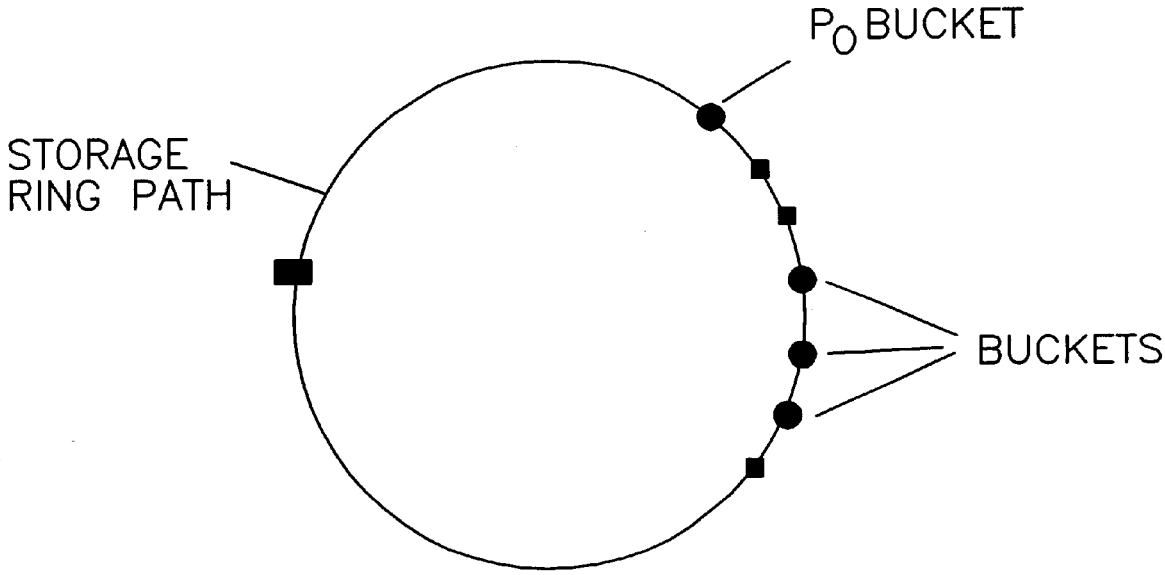
FIG. 5 is a schematic view of stored charge along a storage ring showing the pulsed nature of the emitted radiation.

One can make the APS beam fill pattern very asymmetric so that only one bucket lasting roughly 100 picoseconds would produce x-rays during the 2450 ns window the chopper admits photons. This allows for very accurate study of fast decay systems. An example of an asymmetric loading pattern is depicted in FIG. 5.

Extensive tests have shown that the time jitter in the 2.45 microsecond burst admitted through the chopper is of the order +/−3 ns, i.e., one part in a thousand or one-third of one degree of arc. The channel makes half a revolution in about 373 microseconds at which time a new x-ray burst is transmitted.

The present x-ray beam chopper produces a 2.45 microsecond long x-ray burst every 373 microseconds with a time jitter of 3 nanoseconds.Computation of Open Time The numerical aperture of the channel in the rotor and the beam chopper rotational frequency defines the open time window of the beam chopper. An expression of the time window is given in Equation 5:

$$t_{open}=(\tan^{-1}(d/D))/180\ f \qquad \text{Equation 5}$$

where d is the channel width, D is the channel length and f is the beam chopper rotational frequency in Hz (i.e. RPM/60). By design, the open time for the beam chopper window is chosen to equal 63.91 percent of the revolution time of the APS storage ring ($3.6825844\times10^{-6}$), namely 2.35356 microseconds.

For a channel width of 0.5 mm, this gives a rotor diameter of D=50.8 mm.

The channel cut through the center of the rotor forms two window openings for each revolution of the beam chopper. Hence the final duty cycle is 1 in 102. In summary, for every storage ring revolution that the chopper is transmitting x-rays, the chopper is closed for 101 revolutions. This results in the length of the dark time of the chopper being $DT=373.27\times10^{-6}$ seconds. As such, any detectors and data recorders with a low dark current or which is gateable could be used to record data. Typical detectors are utilized, including, but not limited to photodiodes, CCD cameras, and APD.

Fabrication Detail

Suitable material for the rotor is any high tensile strength material, or composite material that can be machined into the desired rotor shape When x-rays are not being transmitted through the channel opening, the rotor must act as an x-ray beam block. Preferably, the rotor must not only block the initial energy level comprising the impinging beam, but any harmonics thereof. For example, if 8 keV photons are utilized as radiation energy, blockage of harmonics of this radiation of up to 24 keV is desired. As such, the rotor substrate must be opaque to 24 keV photons. By design, an attenuation factor of $10^7$ for 30 keV photons is suitable. Required shielding is calculated from Equation 6, infra:

$$10-7=e^{-\rho a x} \qquad \text{Equation 6}$$

where ρ is the material density, σ is the attenuation cross section, and x is the necessary material thickness. Thus, if nickel is the attenuation material of choice, whereby ρ=8.9 gm/cc and σ=10.23 $cm^2$/gram for 30 keV photons, the minimum thickness is x=0.177 cm.

Suitable housing material is any easily machined material that can contain the rotor should the later fail during rotation.

The housing 120 for the chopper is an aluminum cylinder 99-mm in diameter and 111 mm tall. It is filled with helium at one atmosphere. The disk 120 had a thickness of 5 mm and a 50.8-mm diameter. A layer of x-ray attenuation material was applied to the circumference of the disk so as to prevent leakage of radiation to the detector 134 during shutter closures. An exemplary attenuation material is 1-mm thick nickel coated on the circumference of the disk. This nickel coating provides an x-ray attenuation factor of $10^8$ for x-rays of 30 keV.

The channel 140 had a depth of 2.29 mm and a width of 0.5 mm. The x-ray ports consisted of 0.23 mm thick Beryllium and the optical ports of BK-7 glass. The motor is such that the device may be used in any orientation. The visible light windows 155, 156 should comprise any material that transmits visible light. For x-ray applications, the window material should comprise a material which is transparent for a myriad of x-ray frequencies. A suitable material is beryllium, up to a thickness of 500 microns. The size of the windows should be comparable or larger than the dimensions of the channel through the rotor cylinder. The thickness of the windows will be determined by the internal pressure requirements of the chopper.

Motor Control Detail

A salient feature of the invention is that the motor controller for the rotor utilizes an external clock signal from the synchrotron storage ring. As noted above, the signal is derived from the revolution frequency signal of the storage ring. Commercial digital delay generators, such as the Stanford Research Systems Model #DG535, can be used to fine-tune the position of the open time window with respect to the fill pattern of the storage ring. If the master clock signal is lost, the Motor Controller is provided with a manual reset to prevent automatic turn-on of the beam chopper.

While the invention has been described in the foregoing with reference to details of the illustrated embodiment, these details are not intended to limit the scope of the invention as defined in the appended claims. For example, with the addition of photo diodes, CCD, and x-ray streak cameras, or beam choppers having longer opening times, experiments spanning the time scales from several seconds to about 50 pico- seconds can be conducted.

The embodiment of the invention in which an exclusive property or privilege is claimed is defined as follows:

1. A device for chopping x-ray beams emanating from a source, the device comprising a rotating disk, said disk defining a channel extending along a diameter of said disk wherein the source is pulsating, wherein the angular position of said channel on said rotating disk can be phase locked to said pulsating source, and wherein the variation in the time required for each revolution in the rotational speed of the channel is less than 5 ppm.

2. The device as recited in claim 1 wherein said channel allows traversal by the x-ray beam for a time span shorter than 2500 nanoseconds.

3. The device as recited in claim 1 wherein said rotation allows traversal by the x-ray beam at a frequency of greater than 2600 Hz.

4. The device as recited in claim 1 wherein said disk rotates at a rate as high as 1335 Hz.

5. The device as recited in claim 1 wherein the disk is confined to a controlled atmosphere.

6. The device as recited in claim 5 wherein the controlled atmosphere provides a low-friction environment.

7. The device as recited in claim 1 wherein the source is continuous.

8. A device for chopping x-ray beams comprising a rotating disk having a first side and a second side, said disk defining a passage extending along the entire diameter of the disk.

9. The device as recited in claim 8 wherein the passage is a channel formed on the first side of said disk.

10. The device as recited in claim 8 wherein the passage is a tunnel formed between the first side and second side.

11. A device for chopping x-ray beams comprising:

a disk having a channel extending along a diameter of said disk and positioned at a specific height relative to a base face of said disk;

a shaft connecting said disk to a motor;

an first electrical means for powering said motor and a second electrical means for controlling said motor's speed;

an optical means for determining a speed associated with said disk and for communicating said speed to said second electrical means;

an x-ray beam incident on said disk where said x-ray beam strikes said disk at a specific incident frequency and at a position on said disk coincident with said position of said channel relative to said base of said disk.

12. The device as recited in claim 11 wherein the device is enclosed in a housing having a first pair of ports and a second pair of ports where said first and said second pair of ports are positioned such that when each pair of ports is independently aligned with said channel that a beam will transverse from one port through said channel to the next port of said pair, and where in a plane constructed through said first pair of ports and said second pair of ports, a line joining the first pair of ports is offset from a line joining said second pair of ports by a specified angular separation.

13. The device as recited in claim 11 wherein said first electrical means is in communication with said second electrical means and wherein said second electrical means has a timing device which acts as a master clock for said chopping device.

14. The device as recited in claim 12 wherein said optical means comprises an optical beam which is focused on an outer circumferential surface of said disk, on which, a plurality of equally spaced polished facets exist and where a plurality of reflections from said facets is optically coupled to an optical encoder which transmits a frequency associated with said disk to said second electrical means for comparison to said master clock.

15. The device of claim 14 wherein said second electrical means contains a delay generator to control a phase difference between said master clock and said disk frequency.

16. The device of claim 15 wherein said second electrical means operates to phase-lock said rotational frequency of said disk to said master clock.

17. The device of claim 13 wherein master clock of said timing device is coupled to said specific incident frequency of said x-ray.

* * * * *